US007009470B2

(12) United States Patent
Yatabe et al.

(10) Patent No.: US 7,009,470 B2
(45) Date of Patent: Mar. 7, 2006

(54) WAVEGUIDE-TYPE DIELECTRIC FILTER

(75) Inventors: Yukikazu Yatabe, Hiki-Gun (JP); Hiroshi Kojima, Hiki-Gun (JP); Hiroyuki Katou, Hiki-Gun (JP)

(73) Assignee: Toko, Inc., Tokyo (JP)

( * ) Notice: Subject to any disclaimer, the term of this patent is extended or adjusted under 35 U.S.C. 154(b) by 0 days.

(21) Appl. No.: 10/756,912

(22) Filed: Jan. 13, 2004

(65) Prior Publication Data

US 2004/0140871 A1 Jul. 22, 2004

(30) Foreign Application Priority Data

Jan. 17, 2003 (JP) ..... 2003-009193

(51) Int. Cl.
*H01P 1/208* (2006.01)

(52) U.S. Cl. ..... 333/208; 333/212

(58) Field of Classification Search ..... 333/202, 333/208, 212, 219, 219.1, 206
See application file for complete search history.

(56) References Cited

U.S. PATENT DOCUMENTS

| | | | |
|---|---|---|---|
| 5,642,084 A | 6/1997 | Matsumoto et al. | |
| 5,926,079 A | 7/1999 | Heine et al. | |
| 6,281,764 B1 * | 8/2001 | Arakawa et al. | 333/208 |
| 6,523,248 B1 * | 2/2003 | Snygg et al. | 333/212 |

FOREIGN PATENT DOCUMENTS

| | | |
|---|---|---|
| EP | 0 856 902 A | 8/1998 |
| GB | 2 242 319 A | 9/1991 |
| JP | 60 062202 A | 4/1985 |
| JP | 61 156903 A | 7/1986 |
| JP | 63 220603 A | 9/1988 |
| JP | 6 006108 A | 1/1994 |

* cited by examiner

*Primary Examiner*—Seungsook Ham
(74) *Attorney, Agent, or Firm*—Cohen, Pontani, Lieberman & Pavane

(57) ABSTRACT

Disclosed is a waveguide-type dielectric filter, which comprises a dielectric block, a plurality of resonators formed in the dielectric block, and a coupling portion for adjusting the coupling between the adjacent resonators. The dielectric block includes a pair of dielectric substrates which are divided in the arranging direction of the resonators and joined together through joint surfaces thereof, and a slot formed between the joint surfaces. The slot defines a through-hole severing as the coupling portion between the adjacent resonators. The slot may be formed in each of the joint surfaces or may be formed in only one of the joint surfaces. The above dielectric filter may include input and output sections, and a conductive film may be formed between the joint surfaces to provide a coupling portion of the input or output section. The present invention can provide a waveguide-type dielectric filter capable of being readily produced without causing any problem of mechanical strength.

8 Claims, 4 Drawing Sheets

WAVEGUIDE-TYPE DIELECTRIC FILTER

FIELD OF THE INVENTION

The present invention relates to a waveguide-type dielectric filter, and more particularly to a waveguide-type dielectric filter having a through-hole structure comprised of grooves or slots to adjust the coupling between resonators.

BACKGROUND OF THE INVENTION

As disclosed in U.S. Pat. No. 5,926,079, a plurality of resonators formed in a dielectric block can be coupled together to provide various waveguide-type dielectric filters. FIG. 7 is a perspective view showing one example of such waveguide-type dielectric filters. The dielectric filter comprises a rectangular parallelepiped-shaped dielectric block 70, input and output electrodes 77 provided, respectively, at opposite ends of the dielectric block 70, plural pairs of grooves or slots 79 each disposed between adjacent resonators to extend inward from both the side surfaces of the dielectric block 70 so as to form a coupling iris, and a conductive film covering over the surface of the dielectric block 70 with the slots 79. Each of the coupling irises acts to adjust the coupling between the adjacent resonators. In particular, for obtaining a narrow-band filter, each of the pair of slots is required to have a cutting depth greater than a given value. The increased cutting depth inevitably narrows the width of the coupling iris, which causes deterioration in the strength of the portion of the dielectric filter where the coupling iris is formed.

While a through-hole may be provided between adjacent resonators as a substitute for the slot, this structure involves problems of increase in the process time for forming the through-hole in a dielectric block and difficulty in assuring the working accuracy of the through-hole.

SUMMARY OF THE INVENTION

In view of the above problems, it is an object of the present invention to provide a waveguide-type dielectric filter capable of being readily produced without causing any problem of mechanical strength.

In order to achieve the above object, the present invention employs a structure in which a dielectric block includes a pair of dielectric substrates which are joined together through joint surfaces thereof, and a slot formed between the joint surfaces. More specifically, the present invention provides a waveguide-type dielectric filter comprising a dielectric block, a plurality of resonators formed in the dielectric block, and a coupling portion for adjusting the coupling between the adjacent resonators. In the dielectric filter, the dielectric block includes a pair of dielectric substrates which are divided in the arranging direction of the resonators and joined together through joint surfaces thereof, and a slot between the joint surfaces to provide the coupling portion between the adjacent resonators.

In the above waveguide-type dielectric filter of the present invention, the slot may be formed in each of the joint surfaces in advance, and the dielectric substrates may be joined together while placing the slots in their predetermined positions. Alternatively, the slot may be formed in only one of the joint surfaces, and the dielectric substrates may be joined together.

The above waveguide-type dielectric filter of the present invention may include input and output sections. In this case, a conductive film may be formed between the joint surfaces to provide a coupling portion of the input or output section.

As compared to a waveguide-type dielectric filter adapted to cut off a given frequency bandwidth and formed with slots in the outer surface thereof, the present invention allows the slot to be reduced in depth so as to provide a reduced process time and prevent occurrence of cracks during processing. In addition, even if the depth of the slot is increased up to a certain value, the slot formed within the dielectric block allows the strength of the dielectric filter to be sufficiently maintained. Thus, the dielectric filter according to the present invention is also advantageous to assure enhanced durability and reliability.

Other features and advantages of the present invention will be apparent from the accompanying drawings and from the detailed description.

DESCRIPTION OF THE PREFERRED EMBODIMENT

Figure 1:
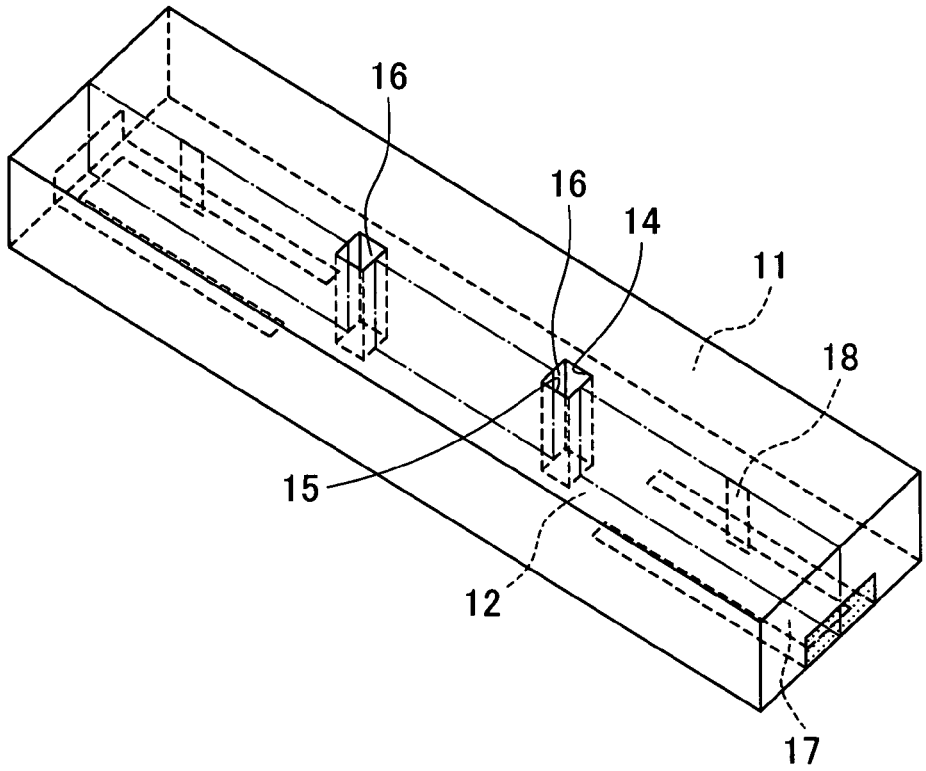
FIG. 1 is a perspective view showing a waveguide-type dielectric filter according to one embodiment of the present invention.

With reference to the drawings, various embodiments of the present invention will now be described. FIG. 1 is a perspective view showing a waveguide-type dielectric filter according to a first embodiment of the present invention. This dielectric filter comprises a pair of first and second dielectric substrates 11, 12 which are joined together through joint surfaces thereof. In this embodiment, the first and second dielectric substrates 11, 12 have the same size (are symmetrically formed). The joint surface of the first dielectric substrate 11 is formed with a plurality (two in this embodiment) of first grooves or slots extending over the entire height of the first dielectric substrate 11, and the joint surface of the second dielectric substrate 12 is formed with a plurality (two in this embodiment) of second grooves or slots extending over the entire height of the second dielectric substrate 11 to be located symmetrically opposed to the first slots. The first and second dielectric substrates 11, 12 are joined together while aligning the first slots with the second slots. Thus, two through-holes 16 are defined between the opposed first and second slots to provide a dielectric filter having 3-stage resonators coupled with each other. Each of the through-holes comprised of the slots serves as a coupling portion for adjusting the coupling between the adjacent resonators. The resonators on both sides of the dielectric filter include input and output sections, respectively. Each of the input and output sections has a tongue-shaped input or output electrode 17 formed in the bottom surface of the dielectric filter. When the dielectric filter is mounted on a printed circuit board, the input and output electrodes 17 are connected to a conductive pattern formed on the printed circuit board.

Figure 7:
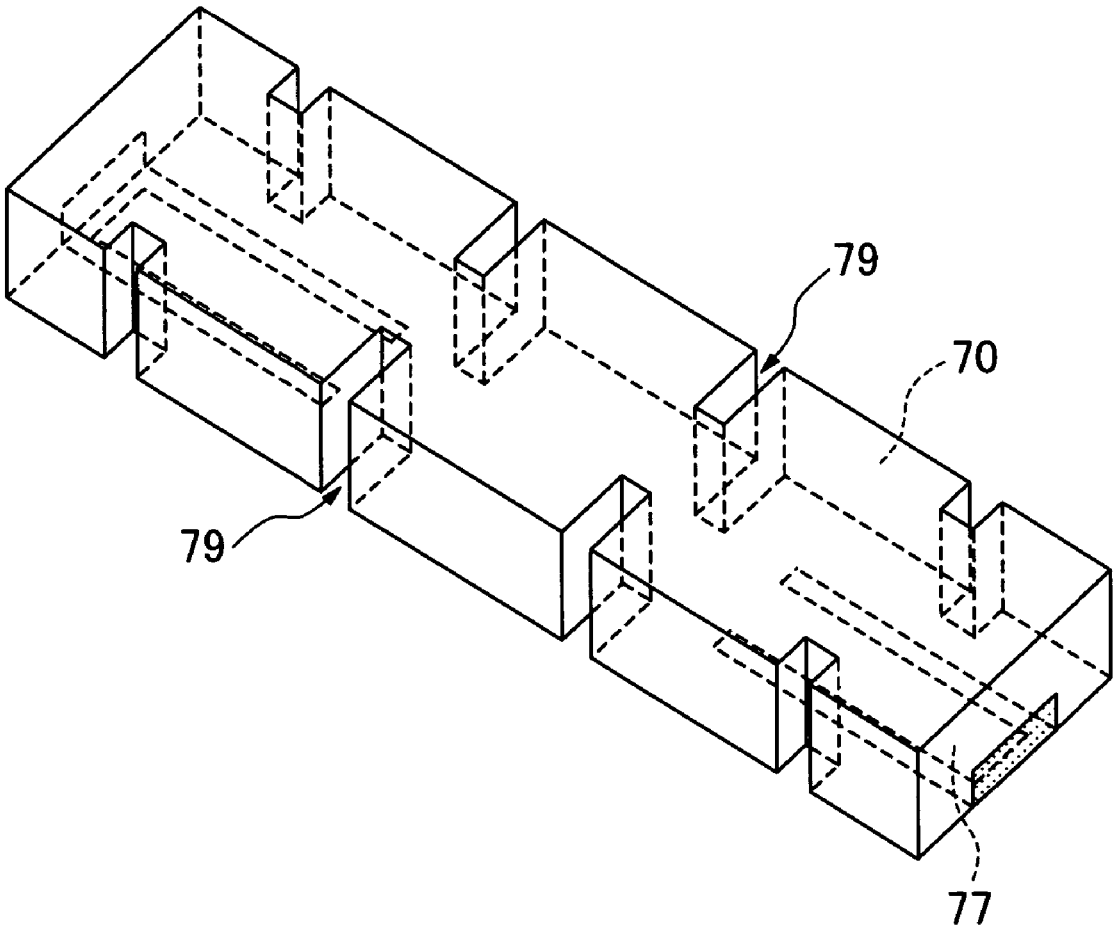
FIG.7 (PRIOR ART)
FIG. 7 is a perspective view showing a conventional waveguide-type dielectric filter.

In this embodiment, the coupling between the input or output section and the adjacent or side resonator is adjusted by a conductive film 18 formed between the joint surfaces. While this coupling may be adjusted by providing shallow slots as shown in FIG. 7, the conductive film 18 can be used as a substitute for the slots to obtain the same effect. In this case, the conductive film 18 is formed such that it is connected to a grounded conductive film covering over the outer surface of the dielectric filter, at the upper surface of the dielectric filter, without any contact with the input or output electrode 17 formed in the bottom surface of the dielectric filter. Each of the coupling portions comprised of the through-holes for adjusting the coupling between the adjacent resonators has a surface covered with a conductive film connected to the grounded conductive film.

Figure 2:
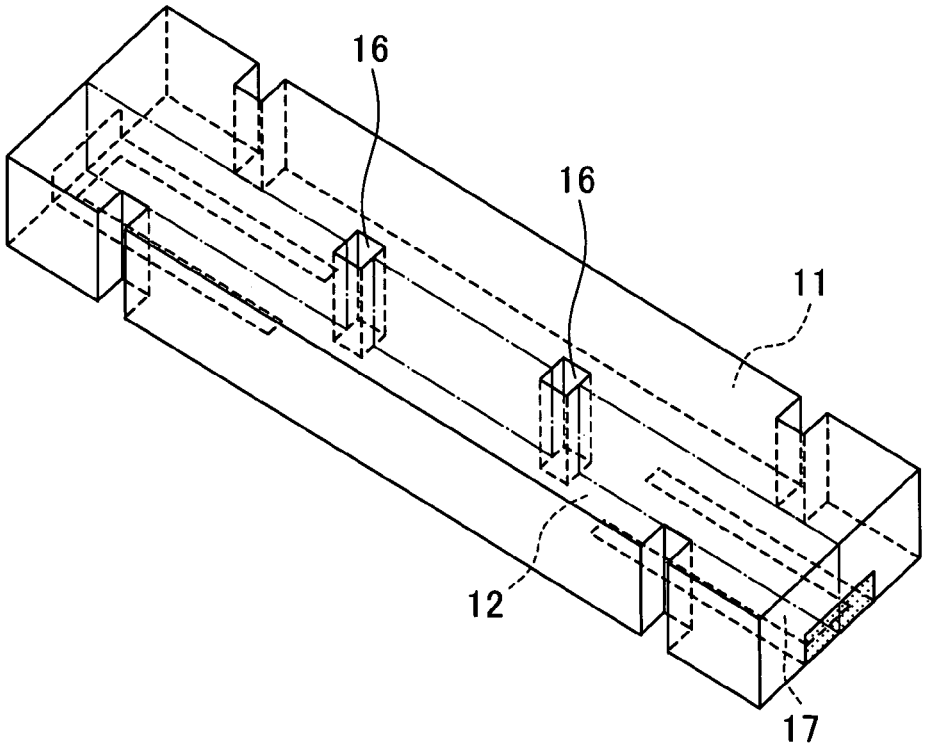
FIG. 2 is a perspective view showing a waveguide-type dielectric filter according to another embodiment of the present invention.

FIG. 2 shows a waveguide-type dielectric filter according to a second embodiment of the present invention. In this embodiment, the coupling between the input or output section and the side resonator is adjusted by a pair of slots formed from the outer surface of the dielectric filter. These slots may have a shallow depth as described above. Thus, the slots can be readily formed without any adverse affect on mechanical strength. Other structures are the same as those in the first embodiment.

Figure 3:
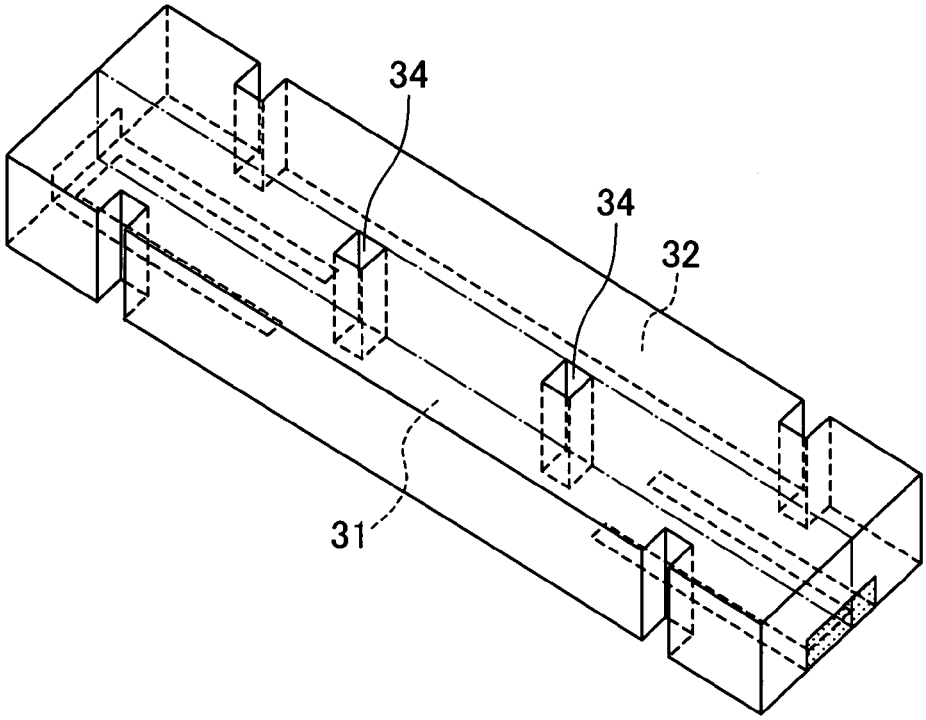
FIG. 3 is a perspective view showing a waveguide-type dielectric filter according to another embodiment of the present invention.

FIG. 3 shows a waveguide-type dielectric filter according to a third embodiment of the present invention. This dielectric filter comprises a pair of first and second dielectric substrates 31, 32 which are joined together through joint surfaces thereof. In this embodiment, the first and second dielectric substrates 31, 32 are asymmetrically formed. That is, only the joint surface of the first dielectric substrate 31 is formed with a plurality (two in this embodiment) of slots 34, and the first dielectric substrate 31 has a width greater than that of the second dielectric substrate 32. In this case, the slots 34 formed only in the joint surface of the first dielectric substrate 31 allow the process and assembly times to be reduced. The coupling between the input or output section and the side resonator is adjusted by a pair of slots formed from the outer surface of the dielectric filter.

Figure 4:
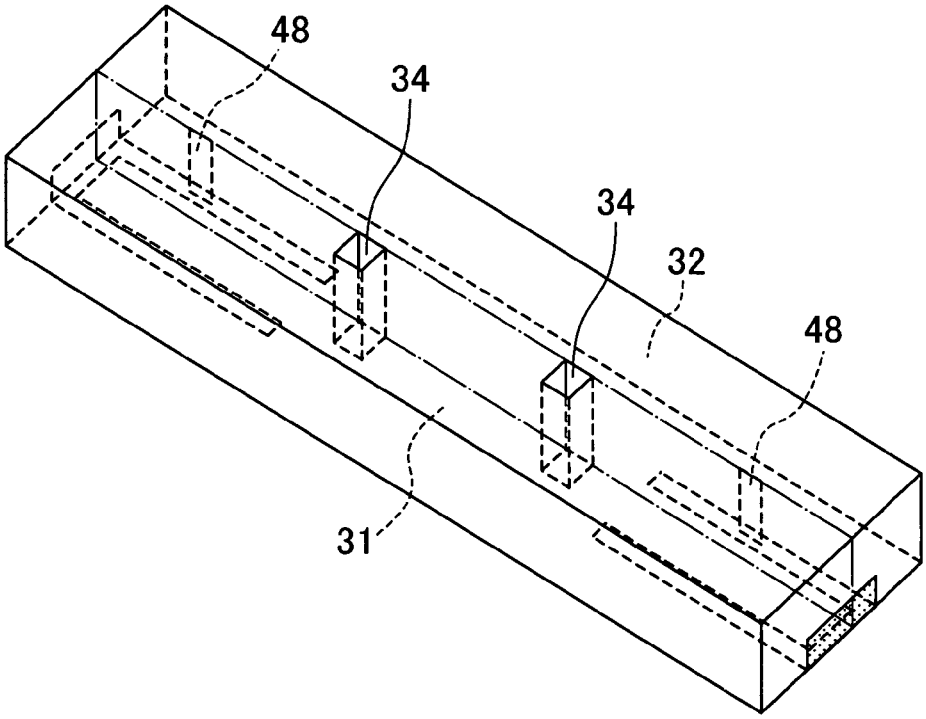
FIG. 4 is a perspective view showing a waveguide-type dielectric filter according to another embodiment of the present invention.

FIG. 4 shows a waveguide-type dielectric filter according to a fourth embodiment of the present invention. This dielectric filter is different from the third embodiment in that the coupling between the input or output section and the side resonator is adjusted by a conductive film 48.

Figure 5:
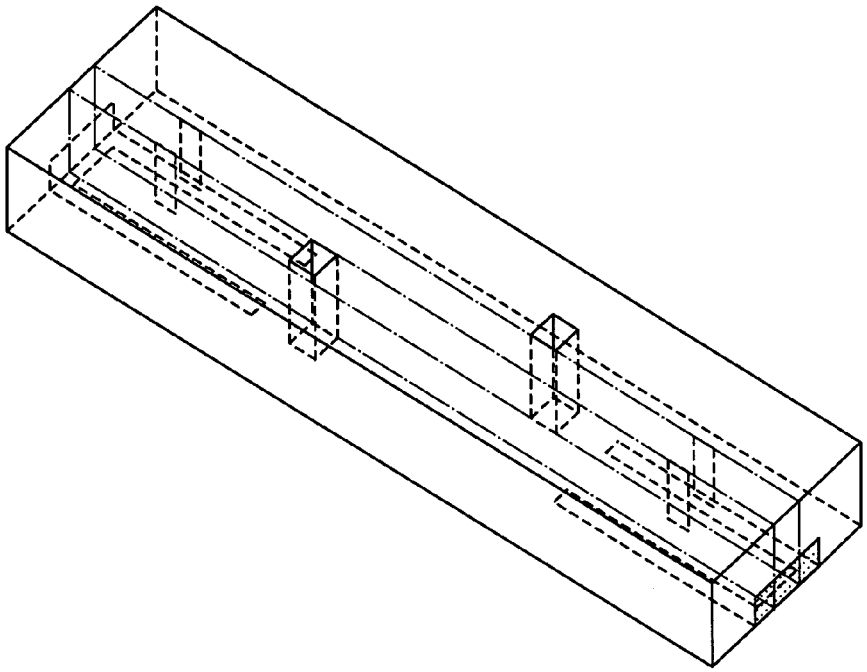
FIG. 5 is a perspective view showing a waveguide-type dielectric filter according to another embodiment of the present invention.

FIG. 5 shows a waveguide-type dielectric filter according to a fifth embodiment of the present invention. The dielectric filter includes a pair of first and second dielectric substrates, and a third dielectric substrate interposed between the first and second dielectric substrates. The joint surface of the first dielectric substrate is formed with a first slot extending over the entire height of the first dielectric substrate, and the joint surface of the second dielectric substrate is formed with a second slot extending over the entire height of the second dielectric substrate at a position different from that of the first slot in the longitudinal direction of the dielectric filter. When the first and second dielectric substrates are jointed together while interposing the third dielectric substrate therebetween, the first and second slots define first and second through-holes, respectively. The coupling between the input or output section and the side resonator is adjusted by a conductive film.

Figure 6:
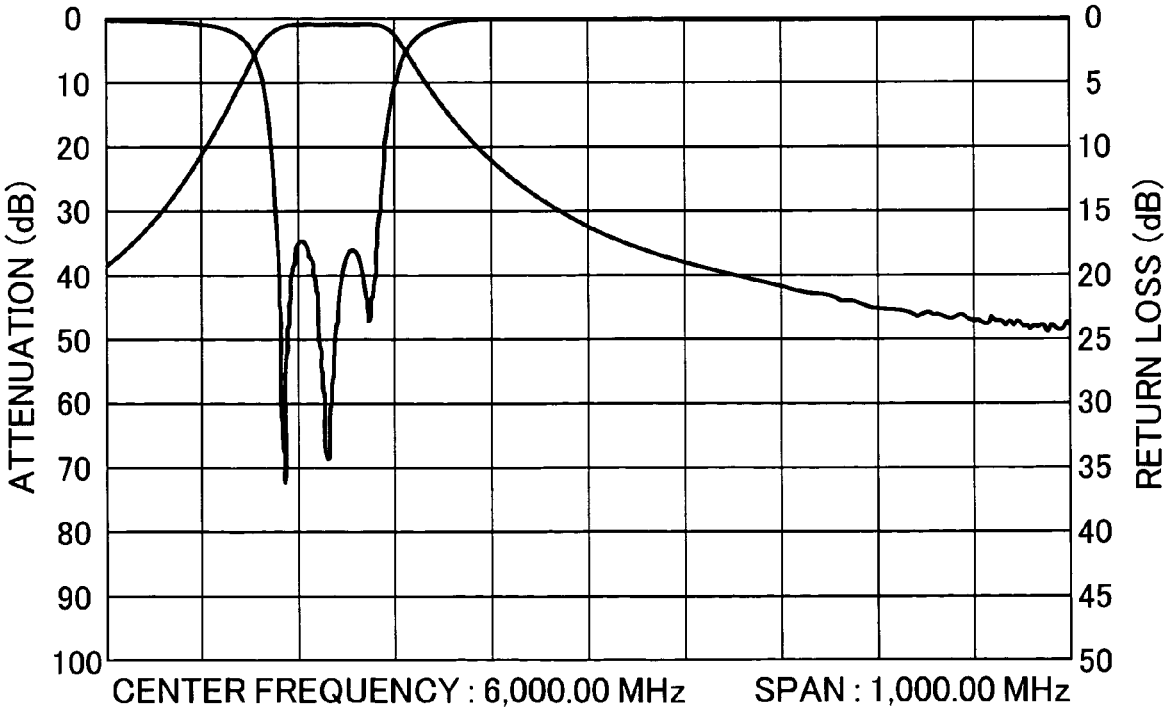
FIG. 6 is an explanatory diagram of the characteristics of a waveguide-type dielectric filter of the present invention.

A waveguide-type dielectric filter was produced by way of trial. A dielectric block of the dielectric filter was comprised of a pair of dielectric substrates which are divided in the arranging direction of resonators and joined together through joint surfaces thereof. The dielectric block had a length of 33.87 mm, a broad side defining a block width of 7.0 mm, and a narrow side defining a block height of 4.0 mm. The joint surfaces extend perpendicular to the broad sides of the generally rectangular block, as is shown in FIGS. 1 through 5. Input and output electrodes each having a width of 1.05 mm were formed in the bottom surface of the dielectric body. The width of dielectric material exposed on both sides of the input or output electrode was set at 2.75 mm. A through-hole having a size of 1.0×0.7 mm was defined by a slot formed between the joint surfaces to provide a coupling portion between the adjacent resonators. The outer surface of the dielectric body except for the input and output electrodes was covered by a conductive film. According to a test result, a flat band-pass characteristic in 5.8 GHz band, and about 20 dB of return loss were exhibited as shown in FIG. 6, which verified effectiveness of the above dielectric filter.

The waveguide-type dielectric filter can be produced by (1) preparing a pair of dielectric substrates, (2) forming a slot in at least one of the joint surfaces of the dielectric substrates, (3) joining the dielectric substrates together through the joint surfaces thereof, and (4) forming a conductive film over the outer surface of the joined dielectric substrates.

The dielectric substrates may be jointed using glass. The conductive film may be coated through a screen printing process, and a conductive paste may be injected into the slot (through-hole). Instead of the injection of the conductive paste, a conductive film may be formed on the surface of the slot before joining the dielectric substrates together. Further, various dielectric substrates different in the depth of the slot may be prepared, and variously combined depending on required characteristics.

Advantageous embodiments of the present invention have been shown and described. It is obvious to those skilled in the art that various changes and modifications may be made therein without departing from the spirit and scope thereof as set forth in appended claims.

What is claimed is:

1. A waveguide-type dielectric filter comprising a dielectric block elongated along a longitudinal axis, a plurality of waveguide resonators formed in said dielectric block and sequentially located one after another along the longitudinal axis, and a coupling portion for adjustably coupling adjacent resonators to each other, wherein said elongated dielectric block includes a pair of dielectric substrates which are elongated parallel to the longitudinal axis and are joined together through respective joint surfaces thereof extending parallel to said longitudinal axis, and wherein the coupling portion for adjustably coupling adjacent waveguide resonators to each other comprises a slot formed in a joint surface of at least one of said pair of dielectric substrates; and wherein said slot has its inner surface covered by a conductive film.

2. The waveguide-type dielectric filter as defined in claim 1, wherein said slot is formed in a joint surface of each of said pair of dielectric substrates.

3. The waveguide-type dielectric filter as defined in claim 2, wherein said slot is formed in a joint surface of each of said pair of dielectric substrates in a symmetrical arrangement.

4. The waveguide-type dielectric filter as defined in claim 1, wherein said slot is formed in a joint surface of only one of said pair of dielectric substrates.

5. The waveguide-type dielectric filter as defined in claim 4, wherein whichever one of said pair of dielectric substrates has said slot formed in only its joint surface has a width greater than that of the other dielectric substrate.

6. The waveguide-type dielectric filter as defined in claim 1, further comprising input and output sections at opposed ends of the dielectric filter, and wherein the coupling portion for adjustably coupling adjacent waveguide resonators to each other comprises a conductive film formed between said joint surfaces.

7. The waveguide-type dielectric filter as defined in claim 1, wherein said dielectric block has spaced opposing relatively broad sides and spaced relatively narrow sides bridging said relatively broad sides, said joint surfaces of said pair of dielectric substrates extending in a plane lying perpendicular to said two relatively broad sides.

8. The waveguide-type dielectric filter as defined in claim 1, wherein said conductive film covers an entire outer surface of said dielectric block except for said input and output sections.

* * * * *